US009521866B2

(12) United States Patent
Koester et al.

(10) Patent No.: US 9,521,866 B2
(45) Date of Patent: Dec. 20, 2016

(54) CIGARETTE PAPER PACK

(75) Inventors: Klaus Koester, Reichshof (DE); Heinrich Hartl, St. Peter am Wimberg (AT); Rupert Greiter, Durach (DE)

(73) Assignee: GIZEH RAUCHERBEDARF GMBH, Gummersbach (DE)

( * ) Notice: Subject to any disclaimer, the term of this patent is extended or adjusted under 35 U.S.C. 154(b) by 253 days.

(21) Appl. No.: 14/123,766

(22) PCT Filed: May 14, 2012

(86) PCT No.: PCT/EP2012/058910

§ 371 (c)(1),
(2), (4) Date: Dec. 4, 2013

(87) PCT Pub. No.: WO2012/168036

PCT Pub. Date: Dec. 13, 2012

(65) Prior Publication Data

US 2014/0097196 A1 Apr. 10, 2014

(30) Foreign Application Priority Data

Jun. 6, 2011 (DE) ..... 20 2011 050 360 U

(51) Int. Cl.

| | |
|---|---|
| ***A24F 17/00*** | (2006.01) |
| ***B65D 83/08*** | (2006.01) |
| ***B65D 5/498*** | (2006.01) |

(52) U.S. Cl.

CPC ..... *A24F 17/00* (2013.01); *B65D 5/48048* (2013.01); *B65D 83/0817* (2013.01)

(58) Field of Classification Search

CPC ... A24F 17/00; A47K 10/422; B65D 5/48048; B65D 83/0817; B65D 83/0858; G07F 11/14

See application file for complete search history.

(56) References Cited

U.S. PATENT DOCUMENTS

| | | | | |
|---|---|---|---|---|
| 2,207,917 | A * | 7/1940 | Fleischer | 206/233 |
| 2,636,599 | A * | 4/1953 | Willis et al. | 221/48 |
| 3,038,625 | A * | 6/1962 | Sinner et al. | 217/33 |
| 3,182,792 | A * | 5/1965 | Viltrakis | 206/449 |
| 4,967,909 | A * | 11/1990 | McKibben | 206/556 |
| 5,485,916 | A * | 1/1996 | Dean | 206/215 |
| 5,901,875 | A * | 5/1999 | Flygenring | 221/56 |
| 5,967,311 | A * | 10/1999 | Ruppert et al. | 206/256 |
| 6,244,502 | B1 * | 6/2001 | Hollar et al. | 229/120.011 |
| 2001/0014275 | A1 | 8/2001 | Focke et al. | |
| 2002/0108962 | A1 * | 8/2002 | Mangin | 221/63 |
| 2004/0182874 | A1 * | 9/2004 | Kringel et al. | 221/34 |
| 2006/0011643 | A1 * | 1/2006 | Emoff et al. | 221/36 |
| 2007/0062843 | A1 * | 3/2007 | Rudd | 206/581 |

(Continued)

FOREIGN PATENT DOCUMENTS

| | | |
|---|---|---|
| CN | 2080755 U | 7/1991 |
| CN | 2234925 Y | 9/1996 |

(Continued)

*Primary Examiner* — Gene Crawford
*Assistant Examiner* — Kelvin L Randall, Jr.
(74) *Attorney, Agent, or Firm* — Norman B. Thot

(57) ABSTRACT

A cigarette paper pack includes a removal opening and a spring element comprising at least one spring. The spring element is configured to feed cigarette rolling papers in a direction of the removal opening.

7 Claims, 9 Drawing Sheets

(56) References Cited

U.S. PATENT DOCUMENTS

| | | | | |
|---|---|---|---|---|
| 2007/0221528 | A1* | 9/2007 | Bobe et al. | 206/494 |
| 2012/0103842 | A1 | 5/2012 | Koester | |
| 2012/0167900 | A1* | 7/2012 | Staric et al. | 131/27.1 |

FOREIGN PATENT DOCUMENTS

| | | | |
|---|---|---|---|
| CN | 1193597 | A | 9/1998 |
| CN | 1296444 | A | 5/2001 |
| DE | 170 032 | A | 4/1906 |
| DE | 10 2009 025 882 | A1 | 12/2010 |
| FR | 353661 | A | 9/1905 |
| FR | 9551 | E | 12/1908 |
| GB | 288 739 | A | 4/1928 |
| WO | WO 95/33667 | A1 | 12/1995 |

* cited by examiner

CIGARETTE PAPER PACK

CROSS REFERENCE TO PRIOR APPLICATIONS

This application is a U.S. National Phase application under 35 U.S.C. §371 of International Application No. PCT/EP2012/058910, filed on May 14, 2012 and which claims benefit to German Patent Application No. 20 2011 050 360.7, filed on Jun. 6, 2011. The International Application was published in German on Dec. 13, 2012 as WO 2012/168036 A1 under PCT Article 21(2).

FIELD

The present invention relates to a cigarette paper pack.

BACKGROUND

Cigarette paper packs that receive cigarette papers (in other words: rolling papers) for rolling cigarettes have previously been described. DE 102009025882 A1 describes, for example, a cigarette paper pack of this type. The prior art provides single packs that contain one stack of often fifty or a hundred individual papers and dual packs containing two stacks of often fifty individual papers in each stack, wherein the stacks are disposed next to each other.

Known cigarette paper packs have the disadvantage that a comfortable removal of rolling papers is not always ensured, particularly when only a few rolling papers remain in the pack. If the cigarette paper pack is intended to hold particularly thin rolling papers, those papers no longer accommodate the full volume of the pack. Rolling papers can thus fall out of the pack even when the pack is still quite full.

SUMMARY

An aspect of the present invention is to provide a cigarette paper pack without the aforementioned disadvantages.

In an embodiment, the present invention provides a cigarette paper pack which includes a removal opening and a spring element comprising at least one spring. The spring element is configured to feed cigarette rolling papers in a direction of the removal opening.

BRIEF DESCRIPTION OF THE DRAWINGS

The present invention is described in greater detail below on the basis of embodiments and of the drawings in which.

DETAILED DESCRIPTION

Figure 1:
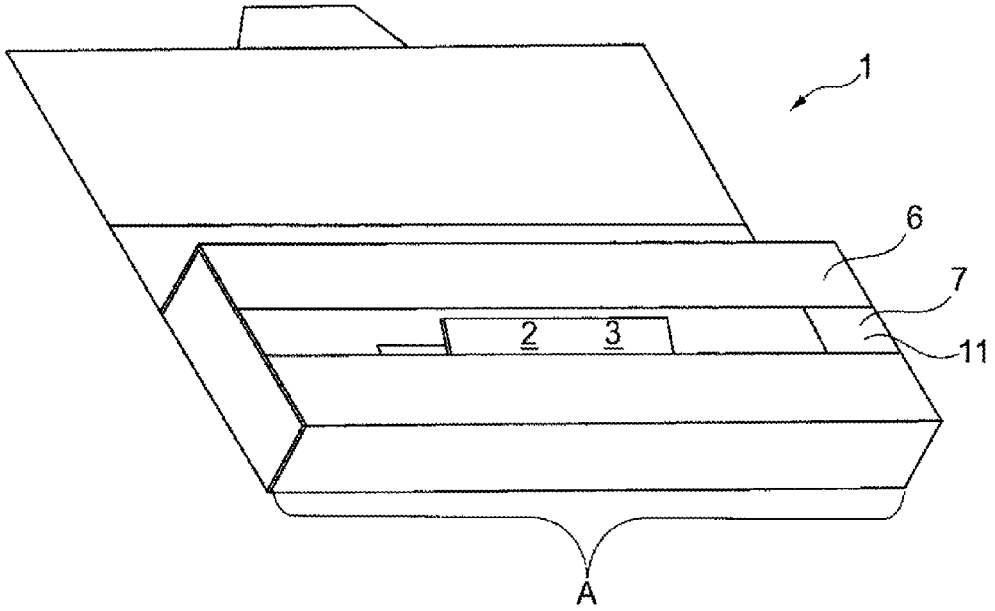
FIG. 1 is a representation of a perspective view of a single cigarette paper pack.

The cigarette paper pack according to the present invention provides for a spring element with at least one spring that has the effect of feeding the cigarette papers in the direction of a removal opening.

It is in this way possible to remove the rolling papers with the same ease throughout, from the very beginning of use, when package is still full, until the very end, when only few rolling papers are left in the cigarette paper pack. The risk that the top cigarette paper slips completely into the package and can only be retrieved with difficulty, for example, is thus reduced.

The spring can be conceivably designed in such a manner that it pushes the cigarette papers against the rim of the removal opening even when only few rolling papers are left in the pack.

It can be sufficient for the spring to be designed such that, although it pushes the rolling papers not against the rim when only few papers are left inside the pack, it advances the rolling papers closer to a point toward the removal opening than where they would be without the spring.

In an embodiment of the present invention, the spring element can, for example, be configured in one piece. A plurality of spring elements is conceivable. Exactly one spring element can, for example, be provided.

In an embodiment of the present invention, the rolling papers can, for example, be folded in the center and stacked in the manner as is known in the art. This means that the stack has a cross-section that corresponds to approximately one half of the area of one rolling paper. Because the rolling papers are stacked into each other, removing one rolling paper will automatically cause a longitudinal side of the rolling paper that is stacked there below to be guided through the removal opening so that it can also be easily removed at a later time. The removal opening can, for example, be smaller than one half of a cigarette rolling paper, as is the case with the known cigarette paper packs, such that the rim or the frame of the removal opening prevents the rolling papers from falling out of the cigarette paper pack.

In an embodiment of the present invention, the at least one spring can, for example, comprise a bending spring, for example, a leaf spring. It has been found that a spring of this kind is particularly cost-effective to produce.

In an embodiment of the present invention, the at least one spring can, for example, comprise paper. The spring can, for example, be formed of paper. Paper in the context of the present invention also includes cardboard. The spring can also comprise other materials, such as, for example, metal or plastic, or it can be formed therefrom. Paper has, however, been found to be well suited.

In an embodiment, the spring element comprises a plurality of springs that can, for example, be spaced in relation to each other.

Aside from the spring element, the cigarette paper pack can, for example, be formed of a paper pack cut that can, for example, be made of paper. A cut is defined as a flat, two-dimensional construct of a certain, chosen contour.

The cigarette paper pack can, for example, comprise a rear adhesive edge that is formed of the paper pack cut and that can, for example, be adjacent to a back wall so as to fix the wall in place.

The length of the cigarette paper pack corresponds approximately to the length of the cigarette papers.

In an embodiment of the present invention, the cigarette paper pack is a single pack. This means that, in the filled state, only a single stack of cigarette papers is available.

In an embodiment of the present invention, the width of the spring can, for example, be smaller than the length of the cigarette papers. It has been found that, despite the minimal stiffness of the cigarette papers, it is not necessary for the spring to be effective across the entire length of the cigarette papers. By providing a spring that is narrower than the length of the rolling paper and that, therefore, does not extend over the total length of the cigarette paper pack, the conditions for producing a particularly easily fabricated cigarette paper pack have been created.

In an embodiment as a single pack, the rear adhesive edge can, for example, include a cut-out that the spring is able to pass through during production. The production process has thus been simplified. The cut-out can, for example, be open on one side.

In an embodiment of the present invention, the cigarette paper pack can, for example, be a dual pack with two rolling paper chambers that are disposed adjacent relative to each other and that each contain one stack of cigarette rolling papers when the pack is full.

The spring element can, for example, comprise an element that fulfills further functions. These functions can be spring-fastening functions. In an embodiment, these further functions can, for example, be alternate or additional functions with regard to spring-fastening functions which do not serve for fastening the spring. It has been found that combining a plurality of functions in the spring element results in a further reduction of the production complexity.

In an embodiment of the present invention as a dual pack, the spring element can comprise an element that constitutes a divider. The spring element is in fact a spring-divider element in that case. It has been found that the spring element is able to assume the function of a divider, whereby a separate dividing means that prevents the two stacks from slipping into each other is omitted.

In an embodiment of the present invention, two springs can, for example, be provided inside one chamber in an embodiment of a dual pack, while exactly one spring can, for example, be provided in the other chamber. The spring that is individually provided in one chamber can, for example, have a width that is smaller than the length of the cigarette papers. The two springs that are provided in exactly one chamber can, for example, be spaced relative to each other by the width of the other spring. These widths are, even when added together, still smaller than the length of the cigarette papers. It has been found that, with minimal production complexity, it is possible to create a particularly functional cigarette paper pack in this way and that, despite the minimal stiffness of the cigarette papers, it is not necessary to cause the spring to be in effect across the entire length of the cigarette papers acting upon the same.

In a dual pack embodiment, the rear adhesive edge of the pack can, for example, include an opening. The spring element can, for example, pass through the opening by way of a spring. The fixation of the spring element is thereby improved, especially during the production of the cigarette paper pack, thereby simplifying the fabrication process.

The cigarette paper pack can, for example, comprise, in a manner known from the prior art, a floor tab and side adhesive edges. In an embodiment of the dual pack, the spring element can, for example, be disposed between the rear adhesive edge and/or the side adhesive edges and the floor tab. In other words, parts of the spring element are disposed between the rear adhesive edge and the floor tab and the other parts of the spring element are disposed between the side adhesive edges and the floor tab.

In an embodiment of the present invention, the spring-divider element can, for example, be formed from a spring-divider cut. The spring-divider cut can, for example, be formed from paper, and the spring-divider element can, for example, be formed from paper by folding the paper. The spring-divider element can, for example, be formed from the spring-divider cut, exclusively by folding. The spring-divider cut can, for example, have a rectangular contour. The spring-divider can, for example, be formed from the spring-divider cut in the following manner: an edge-side central area of the spring-divider cut can, for example, be angled in excess of 90° in one direction to form a first spring. The area that is adjacent to this area can, for example, be angled by approximately 90° in the same direction to obtain a first spring base. Two edge-side areas that are adjacent relative to the central edge-side area on both sides are angled in excess of 90° in the other direction to, for example, form two further fields. The areas that are respectively adjacent to these areas can, for example, be angled relative to the further spring bases by approximately 90° in the other direction. An area that is located opposite the edge-side areas forming the area adjacent relative to the divider can, for example, be angled by approximately 90° to form a divider base. The information as to degrees relates to the areas in the spring-divider cut in the non-angled starting state of the areas. The spring-divider cut includes cut-ins that allow for implementing the angling step. The area that forms the divider base can, for example, be divided in two parts, for example, by a cut-out. It has been found that the spring-divider element that is fabricated in this manner can be produced with functionality and ease.

The present invention further relates to a spring element and a spring-divider cut, each taken separately, of a cigarette paper stack of the previously described type.

The present invention will be described in further detail below based on the drawings.

The cigarette rolling papers were omitted in all drawings to improve the clarity of the drawings.

Figure 2:
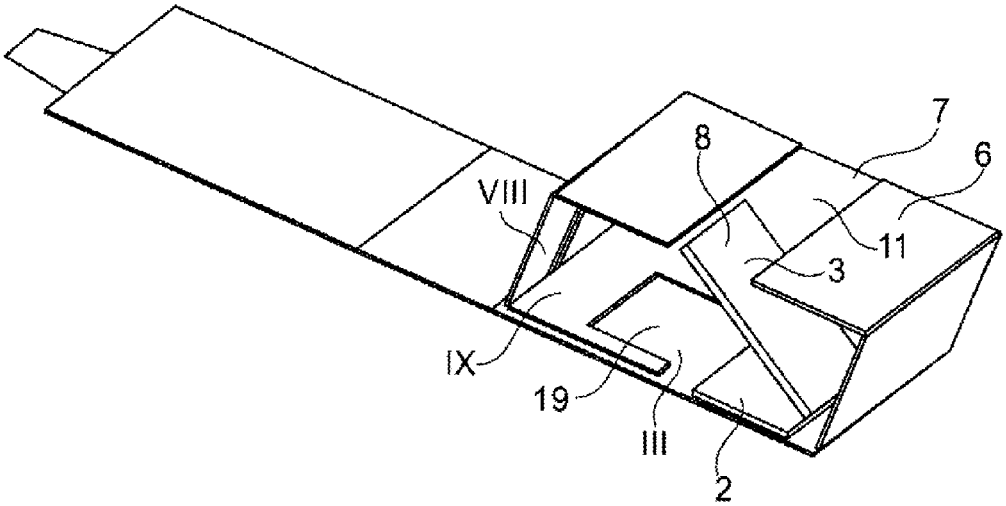
FIG. 2 is a representation of a perspective view of a cut-open cigarette paper pack from FIG. 1.
Figure 3:
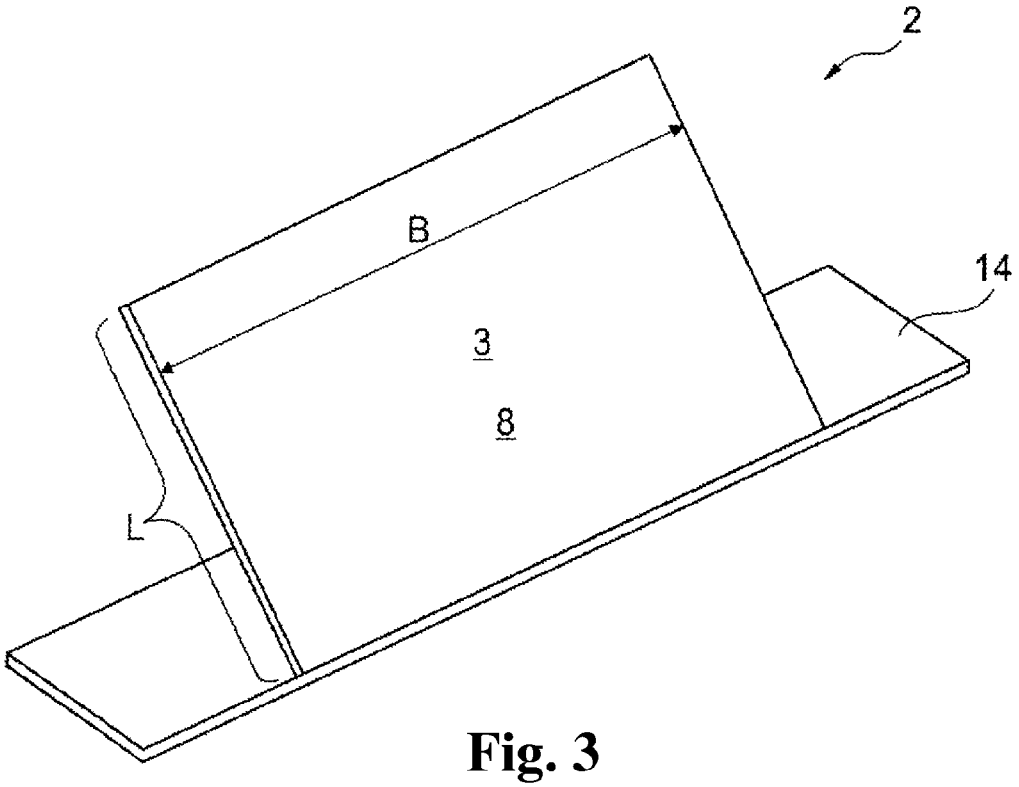
FIG. 3 is a representation of a perspective view of a long configuration of a spring element of a single paper pack.
Figure 4:
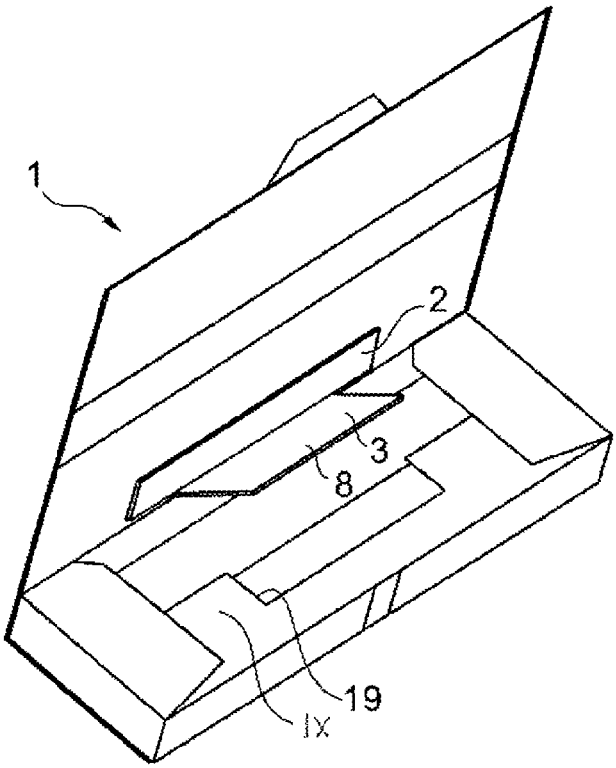
FIG. 4 is a representation of a perspective view, seen from below, of a not yet completely formed single cigarette paper pack.

FIGS. 1 to 5 relate to the embodiment that is designated as a whole by the reference numeral 1. The cigarette paper pack as shown in FIG. 1 includes a rolling paper chamber 11 for receiving the cigarette rolling papers. A removal opening 7 is provided for the consecutive removal of the cigarette rolling papers. This removal opening 7 is surrounded or formed by a rim or a frame 6, respectively. As provided particularly in FIG. 2, the cigarette paper pack 1 provides a spring element 2 that comprises a spring 3, which is configured as a bending spring 8, a leaf spring. The spring element 2 is made of a piece of folded paper. FIG. 2 further shows that the cigarette paper pack 1 includes a back wall VIII that is fixed, for example glued, to a floor tab III by means of a rear adhesive edge IX. The rear adhesive edge IX includes a cut-out 19 that is open to one side and simplifies the manufacture in that it allows for fixing the spring element 2 to the floor tab III prior to the floor tab III being glued to the rear adhesive edge IX. Due to the cut-out 19, it is possible for the spring 3 to be guided through the rear adhesive edge IX during the manufacturing process. The spring 3 therein passes through the cut-out 19. FIG. 4 shows a preliminary stage of this process.

The spring 3 causes the rolling papers, presently not shown, to be fed in the direction of the removal opening 7. The cigarette rolling papers are thus always nicely fixed inside the cigarette paper pack, and they can be comfortably removed for the duration of the total usable time period of the cigarette paper pack. The situation that the topmost cigarette rolling paper completely slips into the rolling paper chamber 11 and is then only difficult to retrieve is thus for the most part precluded. The springs 3, 103, 203, 104, 204, 105, 205 of all shown embodiments serve this purpose.

Figure 5:
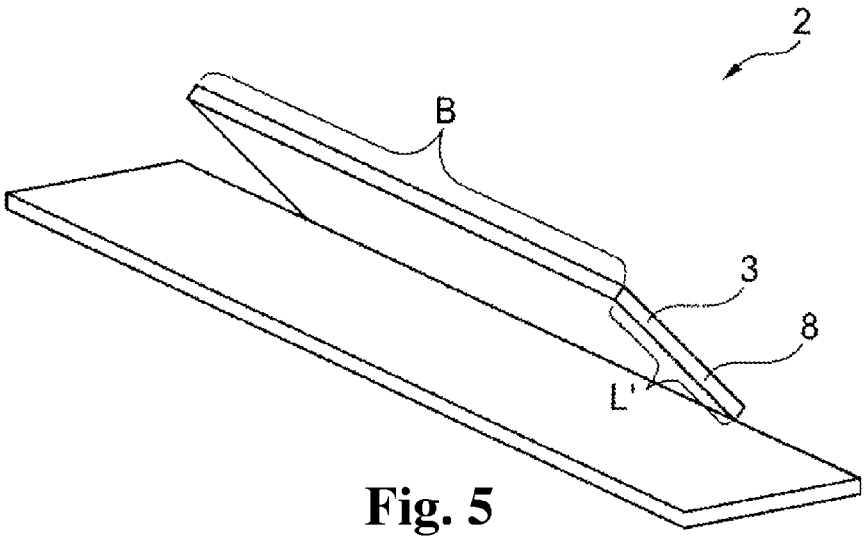
FIG. 5 is a representation of a perspective view of a short configuration of a spring element of a single cigarette paper pack.
Figure 6:
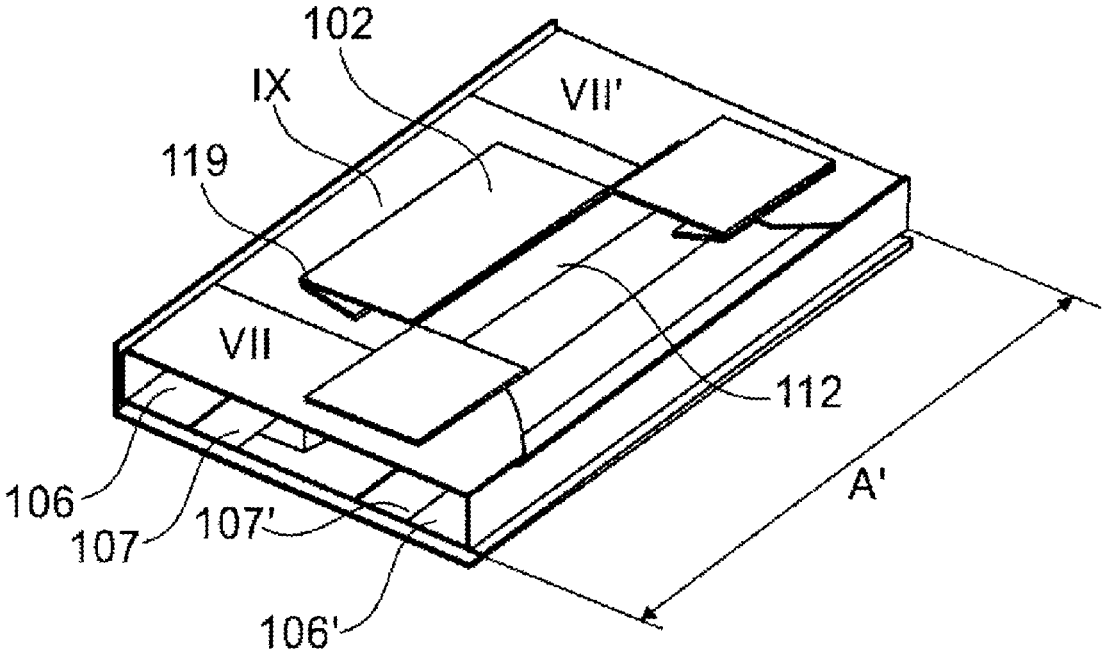
FIG. 6 is a representation of a perspective view, seen against the bottom side of an embodiment of a dual cigarette paper pack according to the present invention, without floor, frontal tab and side tab.
Figure 7:
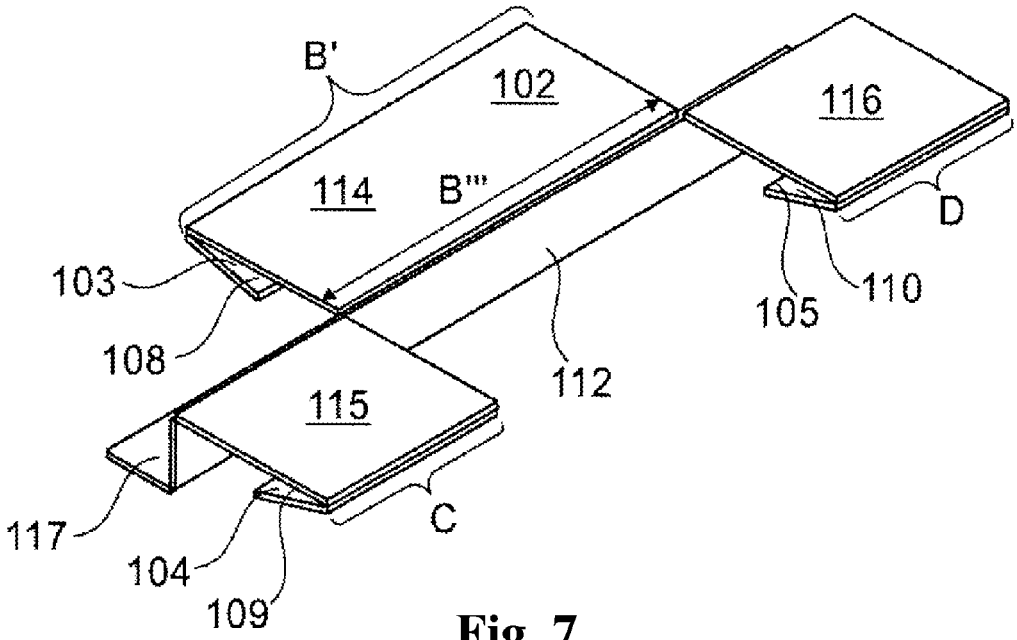
FIG. 7 is a representation of a perspective view of a spring element of a dual cigarette paper pack from FIG. 6.

FIG. 3 shows a spring element 2 with a spring 3 having a length L that is greater than the length L' of the spring element that is depicted in FIG. 5. The spring base 14 of the spring element 2 serves for fastening the spring 3 to the rest of the cigarette paper pack, such as by gluing.

FIG. 5 depicts a spring element 2 for a cigarette paper pack 1 that is designed to accommodate fifty cigarette rolling papers. FIGS. 1, 2 and 4 depict a cigarette paper pack 1 that is designed to accommodate one hundred cigarette rolling papers.

The spring width B is considerably smaller in the single pack than the pack length A. It is smaller than 9/10 of the pack length A. It can be approximately one half of the pack length A.

FIGS. 6 to 30 relate to two embodiments of a cigarette paper pack 100, 200 that is configured as a dual pack.

Figure 8:
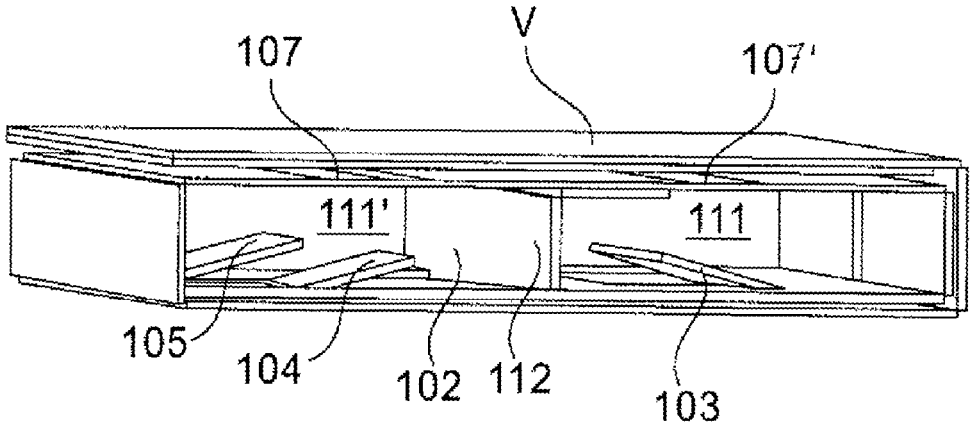
FIG. 8 is a representation of a perspective view, seen from the side, onto a cut-open dual cigarette paper pack from FIG. 6.

As shown, for example in FIG. 8, two rolling paper chambers 111, 111', 211, 211' are provided that are disposed parallel and adjacent to each other. In addition, two removal openings 107, 107', 207, 207' are provided that are disposed adjacent in relation to each other. The two rolling paper chambers 111, 111', 211, 211' are separated by a divider 112, 212. This divider 112, 212 is formed by the spring element 102, 202. Therefore, in this instance, the spring element 102, 202 is simultaneously a spring-divider element 120, 220.

The spring-divider cut, from which the spring element 102, 202 is formed, is cut off a paper strip. It is subsequently grooved, scored and punched.

The spring element 102, 202 comprises a central spring 103, 203, two outer springs 104, 204, 105, 205, a first spring base 114, 214 for the central spring 103, 203, a further spring base 115, 215 for the outer spring 104, 204, a further spring base 116, 216 for the other outer spring 105, 205, a divider 112, 212 and a divider base 117, 217.

Figure 24:
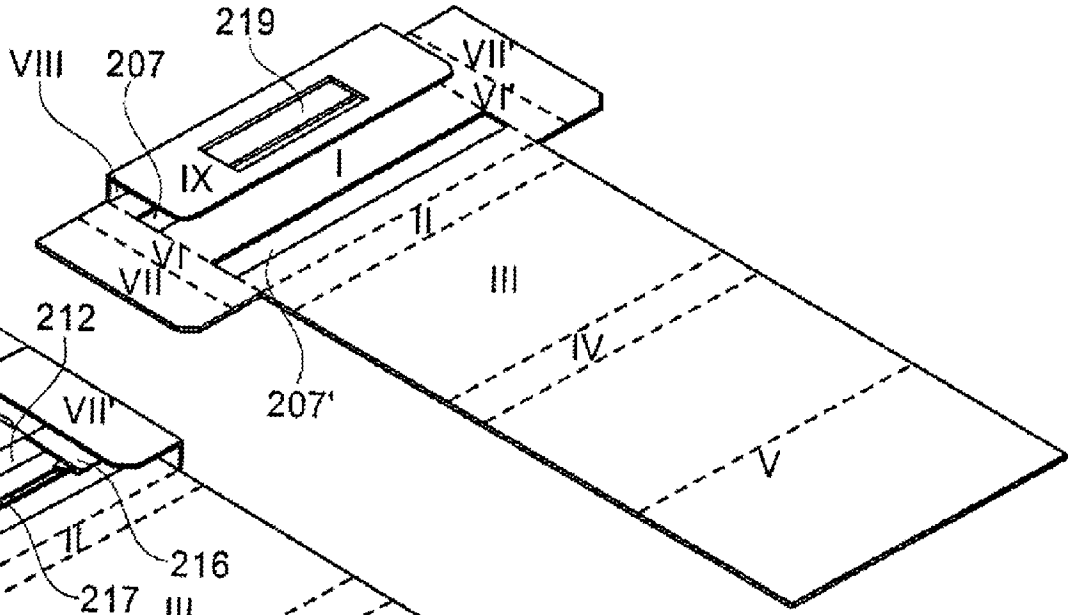
FIG. 24 is a representation of a perspective view of a cigarette paper pack cut that has already undergone the initial folding steps of a second embodiment of a dual cigarette pack according to the present invention.

Aside from the spring element 102, 202, the cigarette paper pack 100, 200 is made from a pack cut that is depicted in FIG. 24 for the second embodiment of the dual pack. The pack cuts of the two shown embodiments of the dual pack do not differ from each other.

FIG. 24 demonstrates that the pack cut comprises areas that can be folded into a top tab I, a front tab II, a floor tab III, a rear tab IV, a lid tab V, two side tabs VI, VI', two side adhesive edges VII, VII', a back wall VIII and a rear adhesive edge IX. This applies for all the depicted embodiments of the cigarette paper pack 1, 100, 200. In the shown embodiments of the dual packs, the lid tab V is folded double. The rear adhesive edge IX includes in both shown embodiments of the dual pack an opening 119, 219. The central spring 103, 203 passes through this opening. The spring base 114, 214 of this spring rests on the rear adhesive edge IX.

The spring width B', B" of the central spring 103, 203 is considerably smaller in the embodiments of the dual pack than the pack length A', A". It is somewhat smaller than half the pack length A', A". The spring widths C, C', D, D' of the outer springs 104, 204, 105, 205 are each approximately one half of the spring width B', B" of the central spring 103, 203.

Figure 10:
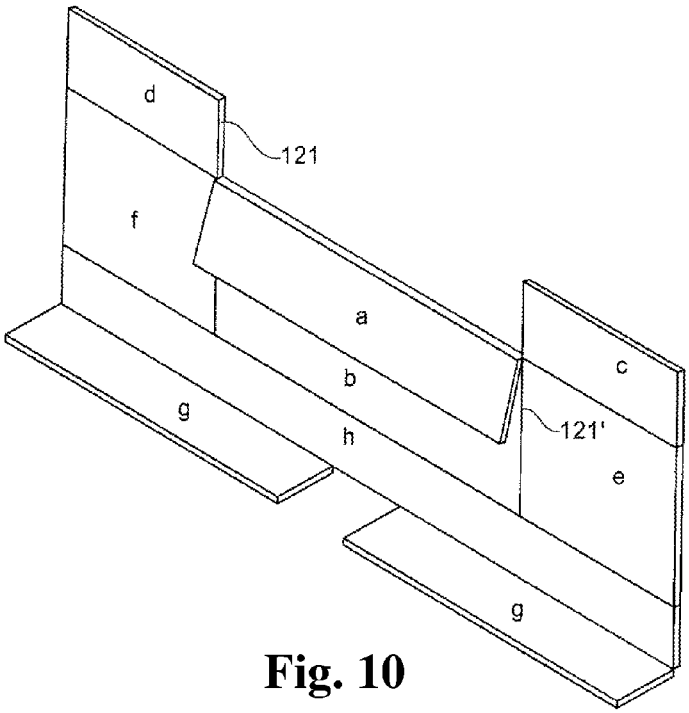
FIG. 10 is a representation of a perspective view, seen onto the spring-divider cut, of a dual cigarette paper pack from FIG. 6 that has already undergone the initial folding steps.
Figure 11:
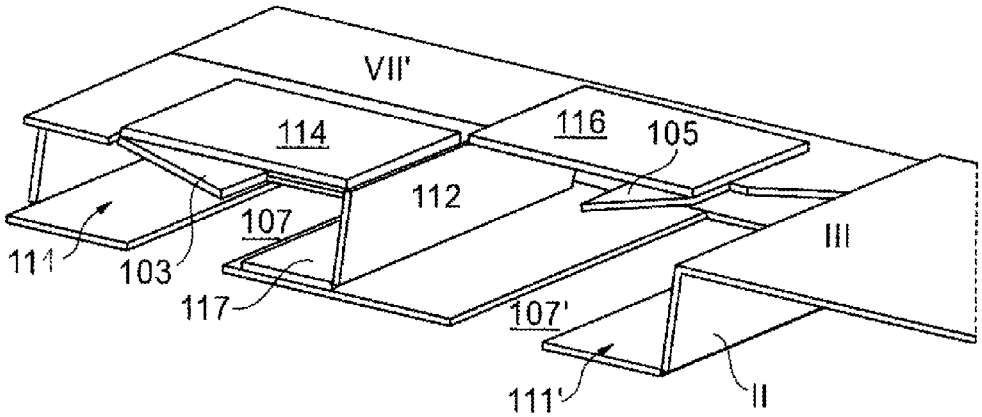
FIG. 11 is a representation of a perspective view, seen against the bottom side, of a cut-open cigarette paper pack from FIG. 6.
Figures 12, 13, 14, 15, 16, 17, 18, 19, 20, 21, 22, 23:
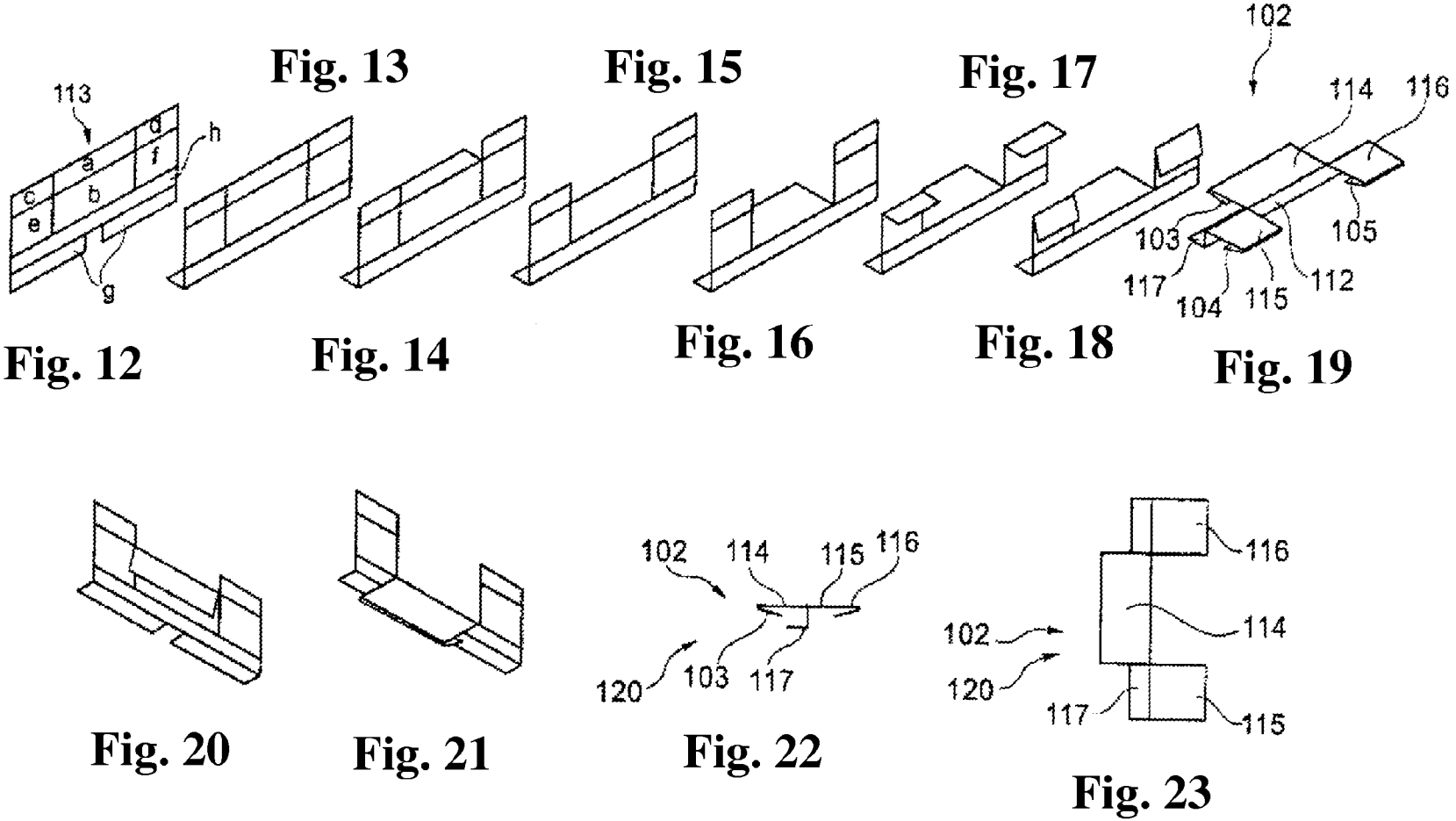
FIG. 12 depicts a folding step of the spring-divider cut of a dual cigarette paper pack from FIG. 6 with regard to the spring element.
FIG. 13 depicts a folding step of the spring-divider cut of a dual cigarette paper pack from FIG. 6 with regard to the spring element.
FIG. 14 depicts a folding step of the spring-divider cut of a dual cigarette paper pack from FIG. 6 with regard to the spring element.
FIG. 15 depicts a folding step of the spring-divider cut of a dual cigarette paper pack from FIG. 6 with regard to the spring element.
FIG. 16 depicts a folding step of the spring-divider cut of a dual cigarette paper pack from FIG. 6 with regard to the spring element.
FIG. 17 depicts a folding step of the spring-divider cut of a dual cigarette paper pack from FIG. 6 with regard to the spring element.
FIG. 18 depicts a folding step of the spring-divider cut of a dual cigarette paper pack from FIG. 6 with regard to the spring element.
FIG. 19 depicts a folding step of the spring-divider cut of a dual cigarette paper pack from FIG. 6 with regard to the spring element.
FIG. 20 is a representation of a view from FIG. 15, seen from another direction.
FIG. 21 is a representation of a view from FIG. 16, seen from another direction.
FIG. 22 is a representation of a cross-section of the spring element from FIG. 19.
FIG. 23 is a representation of a top view onto a spring element from FIG. 19.

Using the example of the first embodiment of the dual pack, FIGS. 12 to 19 show the folding steps that turn the spring-divider cut 113 into the spring element 102. The comments in this section apply correspondingly to the second embodiment. Further production steps, such as gluing or the like, are not needed. The spring-divider element is thus formed from the spring-divider cut only by means of folding. FIGS. 12, 14 and 20 show that, first, a central area on the side of the edge is angled by more than 90° in one direction. FIGS. 12, 16 and 21 depict that the area b, which is adjacent to this area a, is angled by approximately 90° in the same direction. FIGS. 12, 17 to 19 show that the areas c and d, which are laterally adjacent to this area a, are angled by more than 90° in a direction opposite than the area a, and that the areas e and f, which are adjacent to these areas c and d, are angled by approximately 90° in this direction. Particularly FIGS. 12 and 20 demonstrate that the cut-out section g, which is divided in two parts of equal size by a cut-out, is angled by approximately 90°. All areas a to g are rectangular. As depicted in FIG. 10, the spring-divider cut 113 is designed with the cut-ins 121, 121' or grooves, respectively, to facilitate the folding step.

Figure 30:
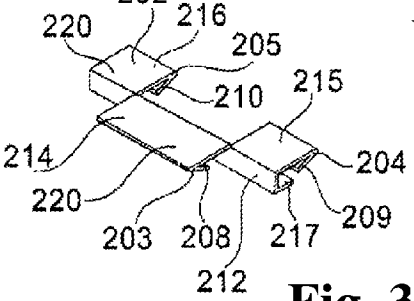
FIG. 30 is a representation of a perspective view of the spring element from FIG. 28.

The spring element 202 of the second embodiment of the dual pack has great similarity with the spring element 102 of the first embodiment of the dual pack. One difference is the fact that the divider base 217, as shown in FIG. 30, is angled on the side where the two springs 204, 205 are disposed by approximately 90°. FIG. 19 depicts that, in the first embodiment of the dual pack, the divider base 117 is angled to the side of the central spring 103. The divider bases 117, 217 in the two depicted embodiments of the dual pack are conceivably angled in the opposite direction of the presently shown direction, respectively.

Figure 9:
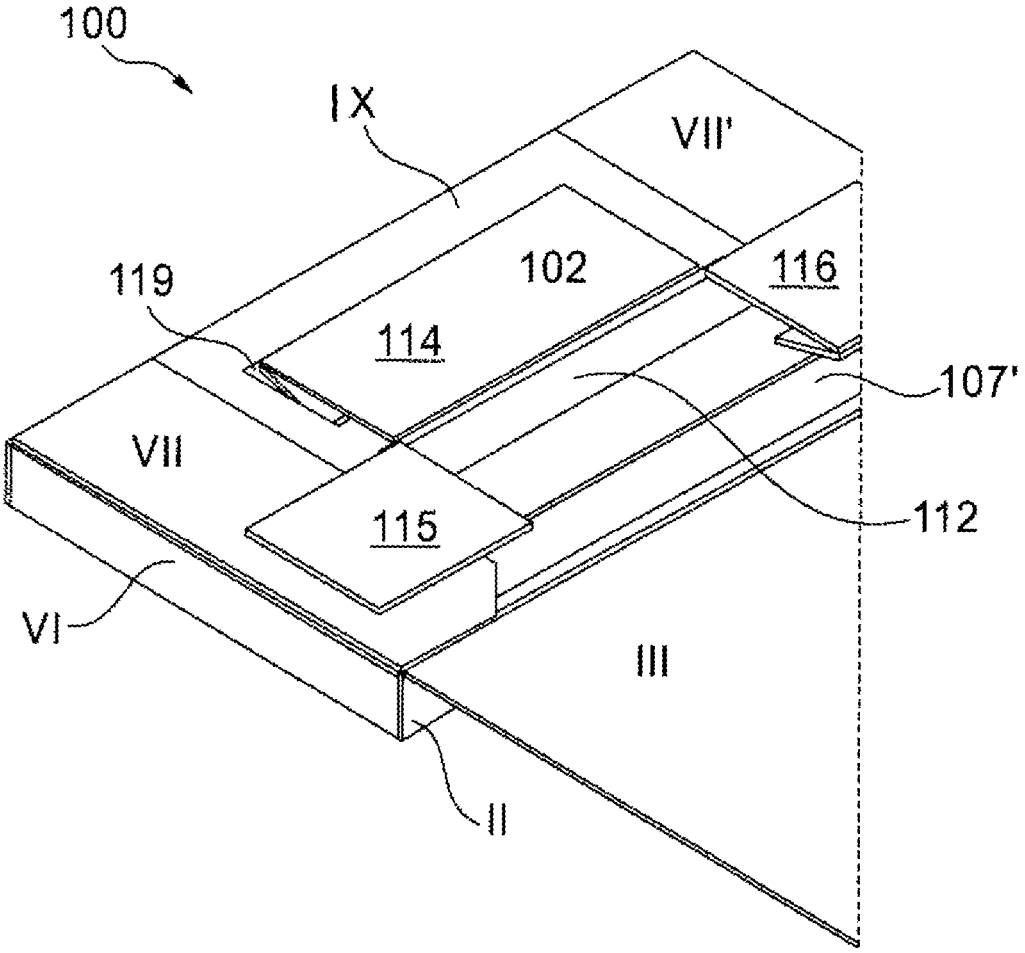
FIG. 9 is a representation of a perspective view, seen from below, onto a part of a not yet fully formed dual cigarette paper pack from FIG. 6.

FIG. 9 shows that, in the first embodiment of the dual pack, which is depicted in FIGS. 6 to 11, the spring element 102 is disposed between the rear adhesive edge IX or the side adhesive edges VII, VII', respectively, and the floor tab III. In fact, in the first embodiment of the dual pack, the further spring bases 115, 116 of the outer springs 104, 105 rest upon the side adhesive edges VII', VII' (FIG. 9). After the floor tab III has been fixed to the side edges VII, VII', the spring element 102 is thus disposed between the floor tab III and the side adhesive edges VII, VII' (with the further spring bases 115, 116) or the rear adhesive rim (with the base 114 of the central spring 103), respectively.

Figure 25:
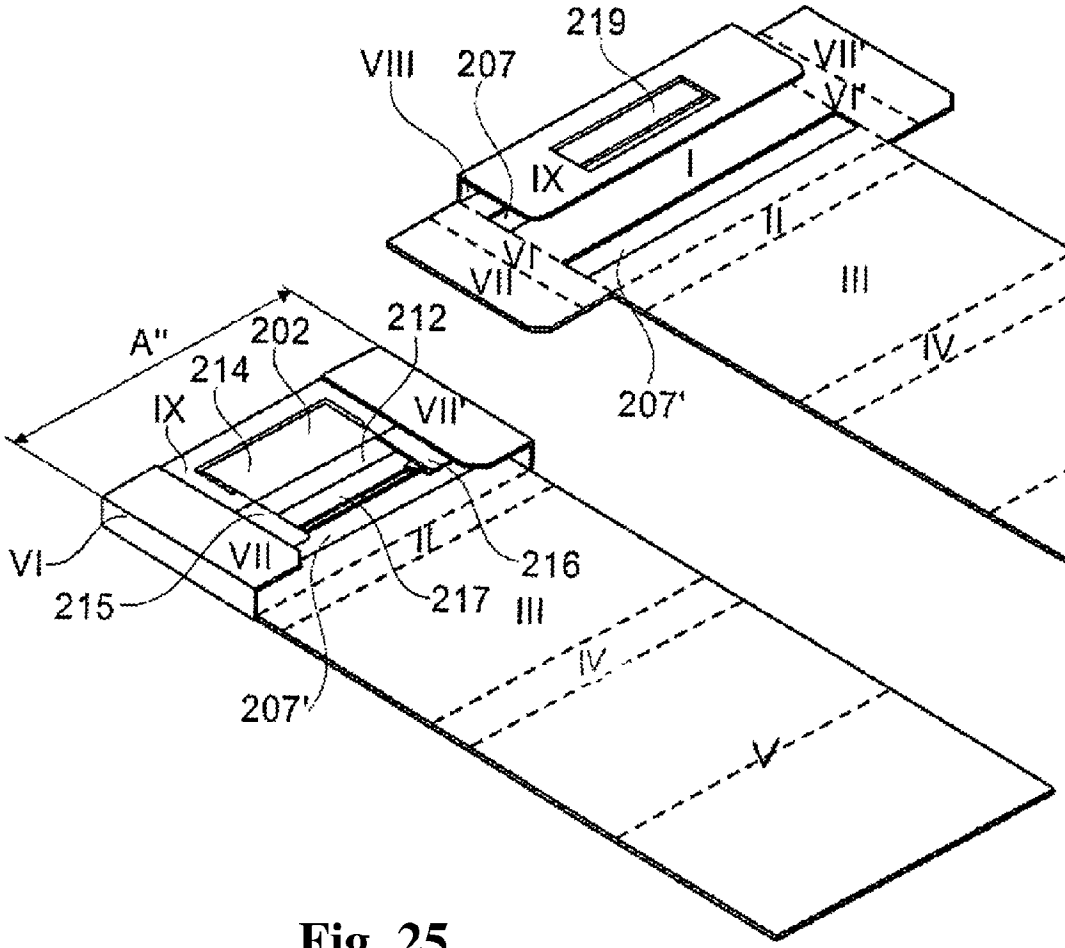
FIG. 25 is a representation of the view from FIG. 24, however, with spring element and a further formed cigarette pack cut.
Figure 26:
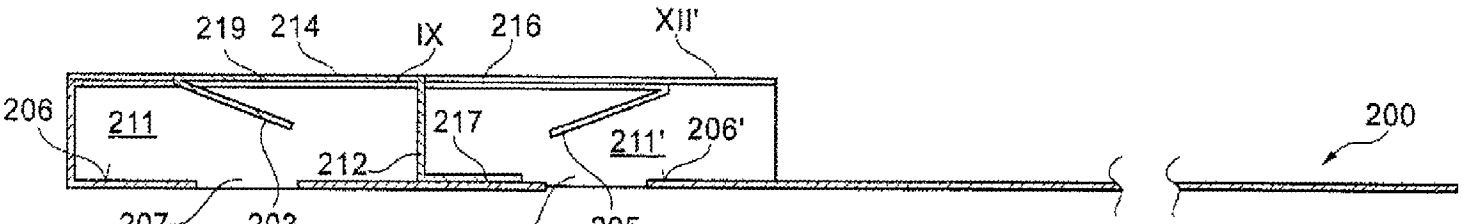
FIG. 26 is a representation of a cross-section of an embodiment of the dual cigarette pack according to the present invention.
Figure 28:
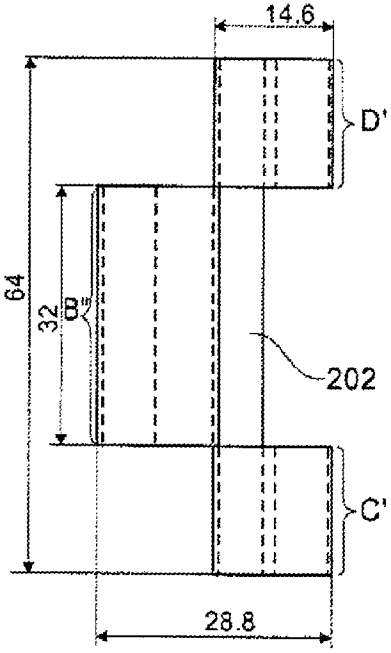
FIG. 28 is a representation of a top view onto a spring element of an embodiment of the dual cigarette paper pack.
Figure 27:
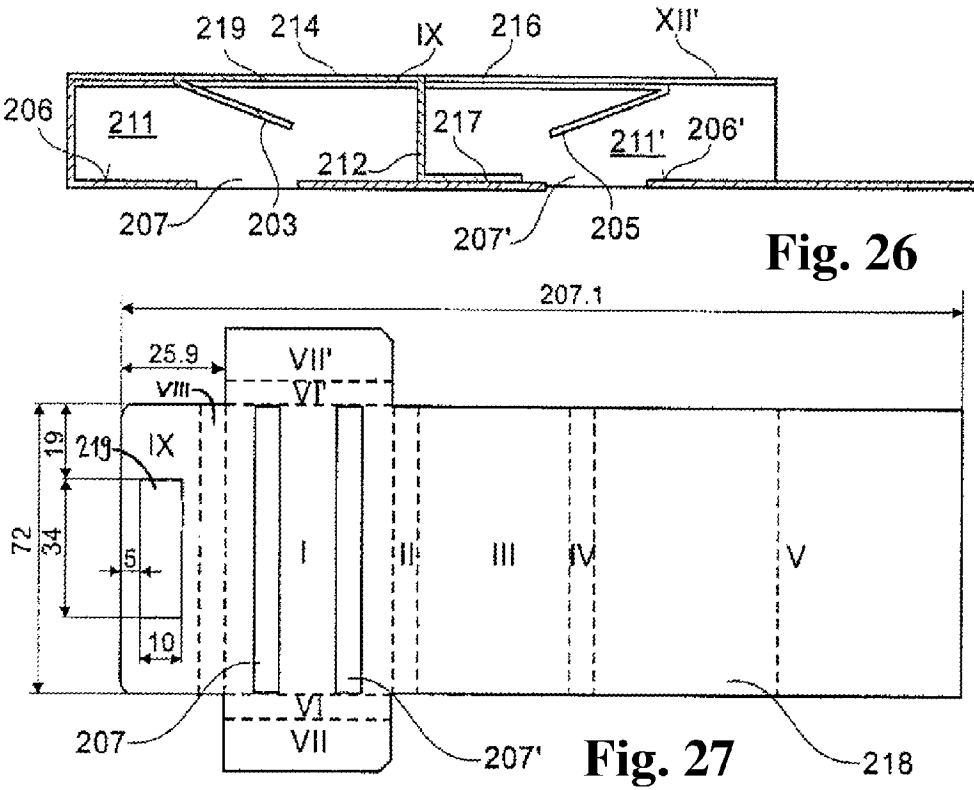
FIG. 27 is a representation of a top view onto a cigarette paper pack of an embodiment of the dual cigarette paper pack.
Figure 29:
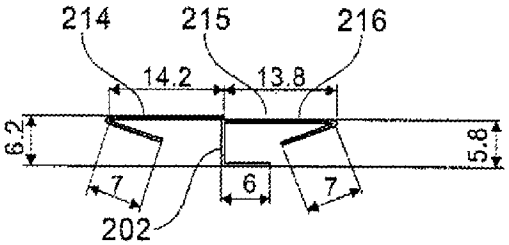
FIG. 29 is a representation of a side view onto the spring element from FIG. 28.

As depicted, in particular, in FIGS. 25 and 26, the further spring bases 215, 216 of the outer springs 204, 205 are not disposed between the side adhesive edges VII', VII" and the floor tab III in the second embodiment of the dual pack; instead they are disposed below the lateral adhesive edges VII, VII'. It is thereby possible to omit the cut-ins or cut-outs, respectively, for the outer springs 104, 105 that are necessary in the first embodiment of the dual pack (not explicitly shown in the figures). However, the first embodiment of the dual pack has the advantage relative to the second embodiment, among others, that the spring elements 102, 202 are more securely fixed in place. From the modified arrangement of the spring element 202 in the second embodiment of the dual pack, there results a minimally different form of this spring element 202 in contrast to the spring element 102 as shown in the first embodiment of the dual pack. As depicted in FIG. 29, the first spring base 214 and the further bases 215, 216 are not disposed at the same height but staggered in relation to each other. FIG. 22 shows that this is not the case for the spring element 102 of the first embodiment of the dual pack.

The production of the dual pack is achieved as follows: the paper strip serves for creating a spring-divider cut (grooving, scoring, punching, cutting). The spring-divider cut is glued into the top tab I by the angled divider base 117, 217. The stacks of cigarette rolling papers are then placed to the left and to the right of this spring-divider cut into the cut pack. The spring-divider cut is then shaped in such a manner so as to create the spring divider element 120, 220. After closing the floor tab III, a so-called two-chamber dual pack with integrated paper spring has been obtained.

In all shown embodiments, the spring widths B, B', B", C, C', D, D' of the springs are, as mentioned previously, considerably smaller than the length of the pack A, A', A".

All cigarette paper packs 1, 100, 200 include a control opening in the back wall VIII by which it is possible to check how many cigarette rolling papers are still present inside the pack.

In all embodiments, the lid tab V forms a reclosable lid that is connected to the rest of the pack and can be pivoted by one edge about a hinge axis. The lid covers up the removal opening or removal openings, respectively, when the pack is in the state with the lid folded closed.

The present invention is not limited to embodiments described herein; reference should be had to the appended claims.

LIST OF REFERENCE SYMBOLS

1, 100, 200 Cigarette paper pack
2, 102, 202 Spring element
3, 103, 203 Spring (central)
104, 204 Spring (outer)
105, 205 Spring (outer)
6, 106, 106', 206, 206' Rim of the removal opening
7, 107, 107', 207, 207' Removal opening
8, 108, 208 Bending spring (central)
109, 209 Bending spring (outer)
110, 210 Bending spring (outer)
11, 111, 111', 211, 211' Rolling paper chamber
112, 212 Divider
113 Spring-divider cut
14, 114, 214 First spring base (for central spring)
115, 215 Further spring base
116, 216 Further spring base
117, 217 Divider base
218 Pack cut
19 Cut-out of the rear adhesive edge
119, 219 Opening of the rear adhesive edge
120,220 Spring-divider element
121,121' Cut-ins
a to g Areas
I Top tab
II Front tab
III Floor tab
IV Rear tab
V Lid tab
VI, VI' Side tab
VII, VII' Side adhesive edge
VIII, VIII' Back wall
IX Rear adhesive edge
A, A', A" Pack length
B, B', B" C, C' D, D' Spring width
L, L' Spring length

What is claimed is:

1. A cigarette paper pack provided as a dual pack, the cigarette paper pack comprising:

a removal opening;

a first rolling paper chamber;

a second rolling paper chamber, the first rolling paper chamber and the second rolling paper chamber being disposed adjacently in relation to each other; and a spring-divider element configured to feed cigarette rolling papers in a direction of the removal opening and to act as a divider, the spring-divider element being formed from a spring divider cut having a rectangular contour, the spring divider cut comprising:

an edge-side central area a;

a central area b disposed adjacent to the edge-side central area a;

an edge side area c and an edge side area d, which are disposed opposite to each other adjacent to the edge-side central area a;

a side area e and a side area f, the side area e being disposed adjacent to each of edge side area c and edge-side central area a, and the side area f being disposed adjacent to each of edge side area d and edge-side central area a;

an area h which forms the divider, area h being disposed adjacent to each of the side area e, the side area f, and the central area b; and an area g disposed opposite to the edge-side central area a, edge side area c, and edge side area d, and adjacent to area h, wherein, the central edge area a is angled in excess of 90° in a first direction so as to form a central spring, the central area b is angled by approximately 90° in the first direction so as to form a first spring base, the edge side area c and the edge side area d are respectively angled in excess of 90° in a second direction which is opposite to the first direction so as to form two respective outer springs, the side area e and the side area f are angled by approximately 90° in the second direction so as to form respective further spring bases, and area g is angled by approximately 90° so as to form a divider base.

2. The cigarette paper pack as recited in claim 1, wherein the central spring and the two outer springs each comprise a bending spring.

3. The cigarette paper pack as recited in claim 1, wherein the central spring and the two outer springs each comprise paper.

4. The cigarette paper pack as recited in claim 1, further comprising a rear adhesive edge comprising a cut-out which is configured to have at least one of the central spring and the two outer springs pass there-through during a production step.

5. The cigarette paper pack as recited in claim 1, wherein the two outer springs are provided in the first rolling paper chamber and the central spring is provided in second rolling paper chamber.

6. The cigarette paper pack as recited in claim 1, wherein the cigarette paper pack further comprises a rear adhesive edge comprising an opening, the spring-divider element being configured to traverse the opening with one of the two outer springs and the central spring.

7. The cigarette paper pack according as recited in claim 6, wherein the cigarette paper pack further comprises a floor tab and lateral adhesive edges, the spring-divider element being disposed between the rear adhesive edge or the lateral adhesive edges, respectively, and the floor tab.

* * * * *